US006132253A

United States Patent [19]

Wu

[11] Patent Number: 6,132,253

[45] Date of Patent: Oct. 17, 2000

[54] CONNECTOR HAVING AN AUXILIARY SHIELDING DEVICE

[75] Inventor: Kun Tsan Wu, Tu-Chen, Taiwan

[73] Assignee: Hon Hai Precision Ind. Co., Ltd., Taipei Hsien, Taiwan

[21] Appl. No.: 09/218,720

[22] Filed: Dec. 22, 1998

[30] Foreign Application Priority Data

Mar. 25, 1998 [TW] Taiwan ..... 87204462

[51] Int. Cl.[7] ..... H01R 19/00

[52] U.S. Cl. ..... 439/607; 439/939

[58] Field of Search ..... 439/607, 609, 439/939, 92, 95, 108

[56] References Cited

U.S. PATENT DOCUMENTS 5,913,698 1/2000 Keng ..... 439/609

6,010,365 1/2000 Wu et al. ..... 439/607

*Primary Examiner*—Neil Abrams
*Assistant Examiner*—Eugene G. Byrd
*Attorney, Agent, or Firm*—Wei Te Chung

[57] ABSTRACT

A shielded connector in accordance with the present invention includes an insulative housing, a plurality of terminals received in the housing, a shell enclosing the housing, and a shield attached to the shell. The shell comprises a receptacle defining a pair of retention openings in opposite side walls thereof. The shield is U-shaped and has an elongate main body with a pair of clips downwardly extending from opposite ends thereof. Grounding plates forwardly and outwardly extend from the main body and each clip. The clips of the shield extend through the openings of the shell for firmly securing the shield to the shell. When the shielded connector is disposed within a computer system, the grounding plates are in constant contact with a housing of the computer system thereby reducing the effects of EMI on signal transmission through the connector.

7 Claims, 6 Drawing Sheets

CONNECTOR HAVING AN AUXILIARY SHIELDING DEVICE

BACKGROUND OF THE INVENTION

1. Field of the Invention

The present invention relates to a an auxiliary shielding device for an electrical connector, and particularly to an auxiliary shielding device which reduces the effect of EMI acting on a connector.

2. The Prior Art

A connector is equipped with an EMI shield to ensure noise-free signal transmission between a computer system and peripherals, such as a mouse, keyboard, and printer. Since the connector is used to integrate different input/output functions, the requirements for stable signal transmission are high. Accordingly, the connector is completely enclosed by the EMI shield.

FIG. 1 shows a conventional connector 5 which is enclosed by a shield on five surfaces. A shielding face 50 which encloses a mating face of the connector 5 is defined with an opening 501 providing an engagement between the shield and the connector 5. The shield further includes grounding legs 51 for establishing a grounding path to a computer housing. As computers become increasingly more complex, many devices require assembly within a limited space. Accordingly, interference between transmission lines thereof increases. Thus, the shield and grounding legs 51 should be adapted to reduce noise or interference, however, the result has been unsatisfactory especially for high frequency signal transmission.

As seen in FIG. 2, interference may result from the installation arrangement between the connector 5 and the computer housing 6. When the connector 5 is assembled to the housing 6, a gap (t) exists therebetween and a portion of the shielding face 50 is exposed to the gap (t) before a mating connector is assembled thereto. Accordingly, EMI through the gap (t) may affect signal transmission.

A connector 7 as shown in FIG. 3 introduces an improvement to address the conventional problem. A shield 71 assembled to the connector 7 forms a first plate 712 and a second plate 713 both outwardly extending from a receptacle 711. Both first and second plates 712, 713 are integrally formed with the shield 71 and tightly clip with an inserted mating connector thereby providing satisfactory EMI protection. However, both plates 712, 713 are integrally formed with the shield resulting in poor resiliency thereof. In addition, a gap may still exist between the plates 712, 713 and a computer enclosure. Consequently, noise is not effectively reduced. Furthermore, such a configuration is not conducive to mass production.

Hence, an improved shielding device is requisite to overcome the disadvantages of the prior art.

SUMMARY OF THE INVENTION

An objective of the present invention is to provide an auxiliary shield which ensures constant contact between a connector and a computer housing.

Another objective of this invention is to provide an auxiliary shield which can be easily manufactured and assembled to a connector.

A further objective is to provide an auxiliary shield which can be easily adapted for assembly to any connector without modifying the structure thereof.

To fulfill the above mentioned objectives, a shielded connector in accordance with the present invention includes an insulative housing, a plurality of terminals received in the housing, a shell enclosing the housing, and a shield attached to the shell. The shell comprises a receptacle defining a pair of retention openings in opposite side walls thereof. The shield is U-shaped and has an elongate main body with a pair of clips downwardly extending from opposite ends thereof. Each clip forms an anchoring tab at an end thereof and defines a pair of retention slots in opposite sides of each clip. A first grounding plate forwardly and outwardly extends from the main body, and a second grounding plate forwardly and outwardly extends from each clip. The clips of the shield extend through the openings of the shell whereby the anchoring tabs abut against inner surfaces of the receptacle for firmly securing the shield to the shell. When the shielded connector is disposed within a computer system, the grounding plates are in constant contact with a housing of the computer system thereby reducing the effects of EMI on signal transmission through the connector.

These and additional objectives, features, and advantages of the present invention will become apparent after reading the following detailed description of the preferred embodiment taken in conjunction with the appended drawing figures.

DETAILED DESCRIPTION OF THE PREFERRED EMBODIMENT

Figure 1:
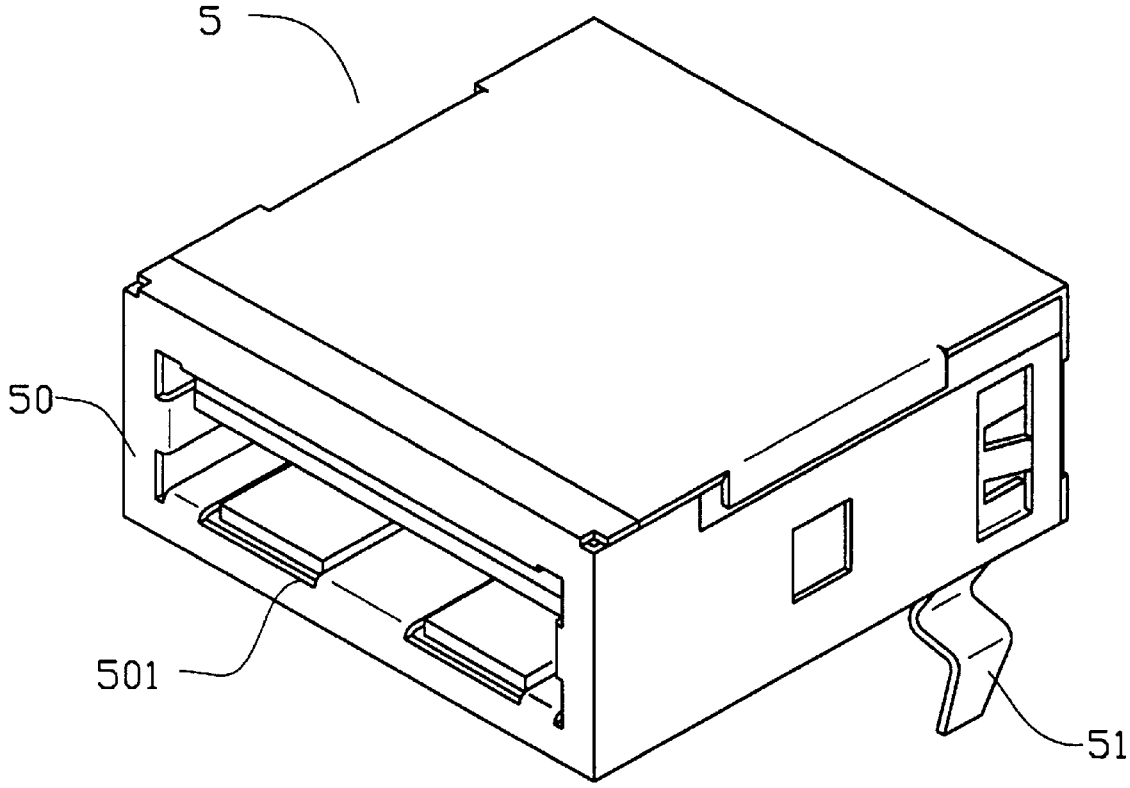
FIG. 1 (PRIOR ART)
FIG. 1 is a perspective view of a conventional shielded connector.
Figure 2:
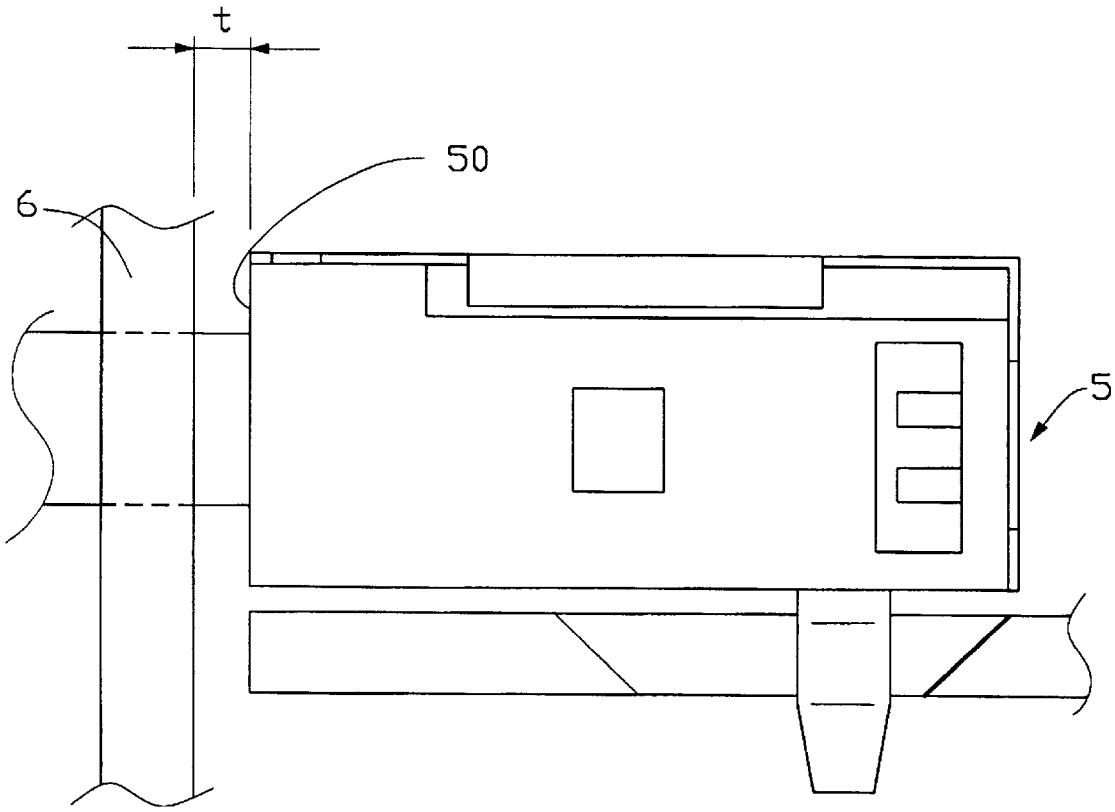
FIG. 2 (PRIOR ART)
FIG. 2 is a side view of FIG. 1 showing the engaging arrangement of the connector with a computer housing.
Figure 3:
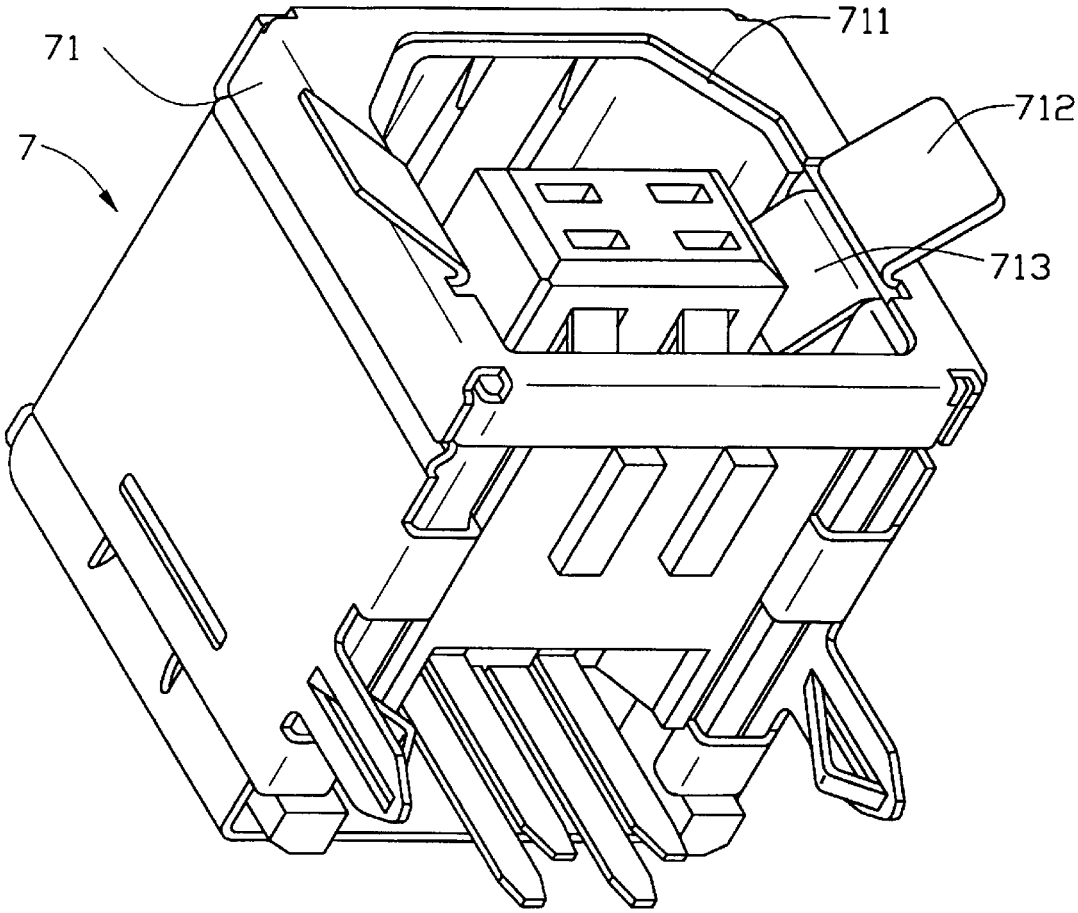
FIG. 3 (PRIOR ART)
FIG. 3 is a perspective view of another conventional shielded connector.
Figure 4:
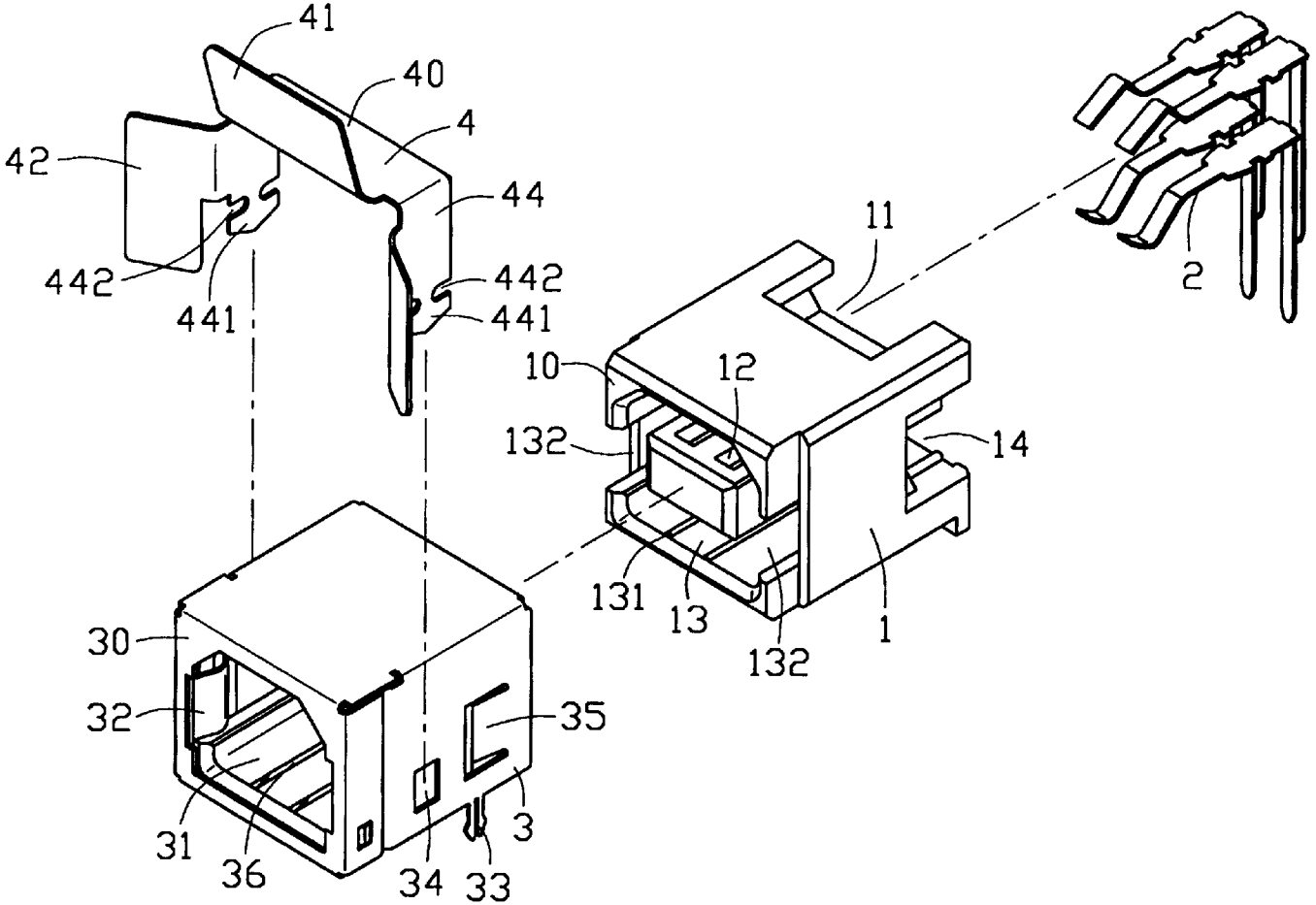
FIG. 4 is an exploded view of a shielded connector in accordance with the present invention.

Reference will now be made in detail to the preferred embodiment of the present invention. Referring to FIG. 4, a shielded connector in accordance with the present invention includes an insulative housing 1, a plurality of terminals 2 received in the housing 1, a shell 3 enclosing the housing 1, and a shield 4 attached to the shell 3.

The housing 1 forms a mating face 10, a guiding face 11 and a plurality of passageways 12 therebetween for receiving the corresponding terminals 2 therein. A receiving slot 13 is defined in the mating face 10 for receiving a mating connector (not shown) therein. A pair of ribs 131 are formed along a bottom surface of the housing 1 between the mating face 10 and the grounding face 11. A pair of cutouts 132 are defined in opposite sides of the housing 1 and are exposed to the mating face 10. A pair of recesses 14 are defined in opposite sides of the housing and are exposed to the guiding face 11.

The shell 3 comprises a receptacle 30 with a space 31 defined between front and rear faces thereof. A pair of resilient plates 32 are formed on inner side walls of the receptacle 30 and extend into the space 31. A pair of retention legs 33 downwardly extend from the side walls of the receptacle 30. A pair of retention openings 34 and a pair of resilient tabs 35 are formed in opposite side walls of the receptacle 30. A pair of channels 36 are defined in a bottom surface of the receptacle 30.

The shield 4 is U-shaped and has an elongate main body 40 with a pair of clips 44 downwardly extending from opposite ends thereof. Each clip 44 forms an anchoring tab 441 at an end thereof and defines a pair of retention slots 442 in opposite sides of each clip 44. A first grounding plate 41 forwardly and outwardly extends from the main body 40, and a second grounding plate 42 forwardly and outwardly extends from each clip 44.

Figure 5:
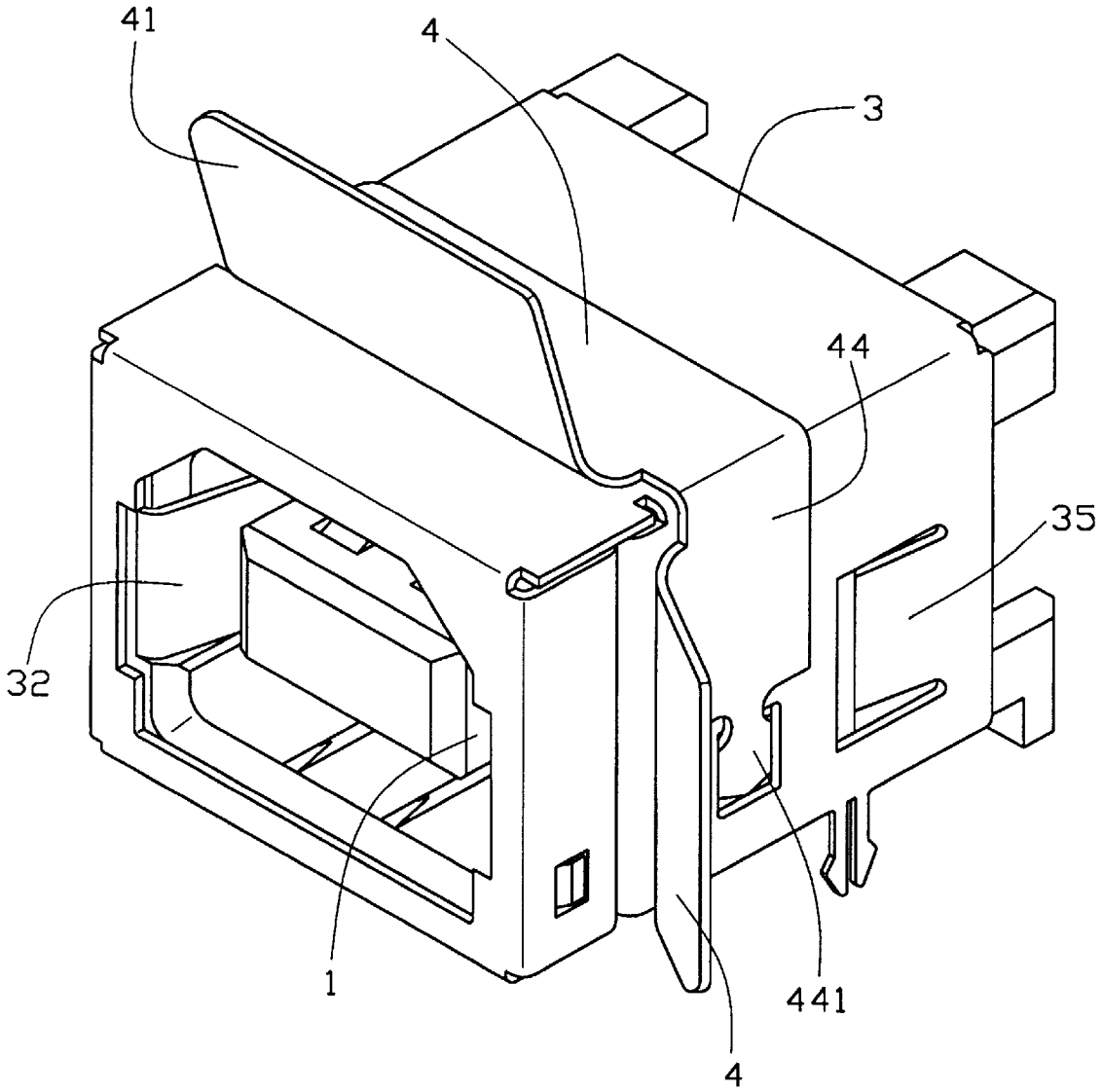
FIG. 5 is an assembled view of FIG. 4.

In assembly, as seen in FIG. 5, the terminals 2 are firstly received in the corresponding passageways 12 of the housing 1. The ribs 131 of the housing 1 are aligned with the channels 36 of the shell 3 whereby the housing 1 is guidingly inserted into the space 31 of the receptacle 30. The resilient plates 32 of the shell 3 engage with the cutouts 132 of the housing 1 and the resilient tabs 35 engage with the recesses 14 to secure the shell 3 to the housing 1. The clips 44 of the shield 4 extend through the openings 34 of the shell 3 whereby the anchoring tabs 441 abut against inner surfaces of the receptacle 30 and the retention slots 442 engage with top edges of the openings 34 for firmly securing the shield 4 to the shell 3.

Figure 6:
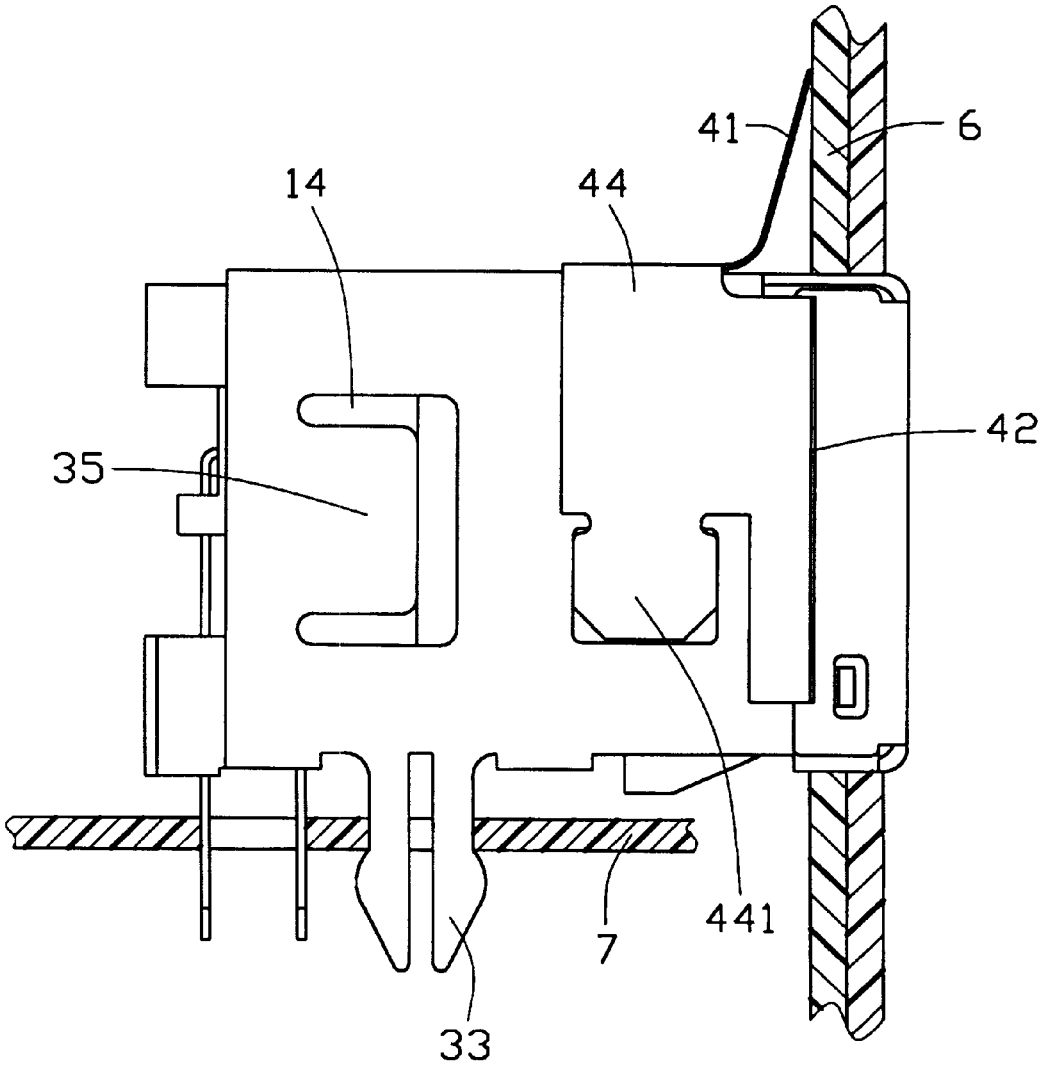
FIG. 6 is a side view of the shielded connector mounted on a PC board and contacting a computer enclosure.

Referring to FIG. 6, when the shielded connector is disposed within a computer system, the retention legs 33 of the shell 3 and tail portions (not labeled) of the terminals 2 are received within corresponding holes (not labeled) defined in a PC board 7. The grounding plates 41, 42 are in constant contact with an enclosure 6 of the computer system to reduce the effect of EMI on signal transmission through the connector.

It is noted that the shell 3 defines a top wall and two side walls wherein the retention opening 34 are provided in the side walls. The U-shaped shield 4 have the main body 40 and two clips 44 seated on the top wall and two side walls, respectively, wherein the clips 44 are latched by the retention openings 34. Under this situation, when the front portion of the shell 3 is received within the opening of the enclosure 6, the grounding plates 41, 42 can be in constant contact with the enclosure 6.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claimed is:

1. A shielded connector for mounting to a PC board within a computer enclosure, comprising:

an insulative housing defining a plurality of passageways therein for receiving a corresponding plurality of terminals therein;

a shell for attaching to and enclosing the housing, comprising a receptacle defining at least a retention opening in a side wall thereof; and a shield having an elongate main body with at least a clip downwardly extending from an end thereof, a first grounding plate forwardly and outwardly extending from the main body, and a second grounding plate forwardly and outwardly extending from each clip;

wherein each clip extends through the corresponding retention opening of the shell to secure the shield to the shell and the grounding plates contact the enclosure when the connector is mounted to the PC board for reducing the effects of EMI on signal transmission through the connector.

2. The connector as described in claim 1, wherein each clip forms an anchoring tab at an end thereof, said anchoring tabs abutting against inner surfaces of the receptacle.

3. The connector as described in claim 1, wherein a pair of retention slots are defined in opposite sides of each clip for facilitating engagement with the retention openings of the shell.

4. Shielding means for attaching to an electrical connector, comprising:

a shell for attaching to and enclosing the connector, comprising a receptacle defining at least a retention opening in a side wall thereof; and a shield having an elongate main body with at least a clip downwardly extending from an end thereof, a first grounding plate forwardly and outwardly extending from the main body, and a second grounding plate forwardly and outwardly extending from each clip;

wherein each clip extends through the corresponding retention opening of the shell to secure the shield to the shell for reducing the effects of EMI on signal transmission through the connector.

5. The shielding means as described in claim 4, wherein each clip forms an anchoring tab at an end thereof, said anchoring tabs abutting against inner surfaces of the receptacle.

6. The connector as described in claim 4, wherein a pair of retention slots are defined in opposite sides of each clip for facilitating engagement with the retention openings of the shell.

7. A shielded connector for mounting to a PC board within a computer enclosure, comprising:

an insulative housing;

a shell enclosing the housing and defining a top wall and two side walls;

a U-shaped shield including a main body and two clips respectively seated on the top wall and two side walls of the shell, and at least one forwardly and outwardly extending grounding plate;

the clips being retained on the corresponding side walls, respectively; wherein the shield is positioned behind a front portion of the shell; whereby when said front portion of the shell is received within an opening of the computer enclosure, the grounding plate may engage with the enclosure.

* * * * *